US007174121B2

(12) United States Patent
Kuma et al.

(10) Patent No.: US 7,174,121 B2
(45) Date of Patent: Feb. 6, 2007

(54) APPARATUS FOR IMAGE FORMING AND IMAGE DEVELOPING WITH AN IMPROVEMENT OF TONER CONTAINER HOLDING

(75) Inventors: Kazuosa Kuma, Yokohama (JP); Yuusuke Noguchi, Yokosuka (JP); Hiroshi Ishii, Yokohama (JP); Makoto Kikura, Yokohama (JP); Yutaka Fukuchi, Yokohama (JP); Kazuki Suzuki, Kawaguchi (JP)

(73) Assignee: Ricoh Company, Ltd., Tokyo (JP)

( * ) Notice: Subject to any disclaimer, the term of this patent is extended or adjusted under 35 U.S.C. 154(b) by 98 days.

(21) Appl. No.: 11/066,270

(22) Filed: Feb. 28, 2005

(65) Prior Publication Data

US 2005/0226657 A1 Oct. 13, 2005

(30) Foreign Application Priority Data

Feb. 27, 2004 (JP) ..... 2004-054810

(51) Int. Cl.
*G03G 15/08* (2006.01)

(52) U.S. Cl. ..... 399/258; 222/DIG. 1; 399/120; 399/262

(58) Field of Classification Search ..... 222/DIG. 1; 399/107, 167, 120, 258, 260, 262, 119
See application file for complete search history.

(56) References Cited

U.S. PATENT DOCUMENTS 5,867,757 A * 2/1999 Okazaki et al. ..... 399/262
7,079,788 B2 * 7/2006 Ban et al. ..... 399/120

FOREIGN PATENT DOCUMENTS

| | | |
|---|---|---|
| JP | 2004-218677 | 8/2004 |
| JP | 2004-240403 | 8/2004 |
| JP | 2004-246185 | 9/2004 |

OTHER PUBLICATIONS

U.S. Appl. No. 11/377,568, filed Mar. 17, 2006, Katoh et al.
U.S. Appl. No. 11/247,269, filed Oct. 12, 2005, Uchiyama et al.

* cited by examiner

*Primary Examiner*—Hoang Ngo
(74) *Attorney, Agent, or Firm*—Oblon, Spivak, McClelland, Maier & Neustadt, P.C.

(57) ABSTRACT

An image forming apparatus includes a toner container, an image development mechanism, and a toner container holder. The toner container has a longitudinal length with first and second longitudinal ends, is driven for rotation to move the toner. The image development mechanism develops an electrostatic latent image into a toner image. The toner container holder includes a base plate onto which the toner container is inserted in a direction perpendicular to the longitudinal direction of the toner container. The toner container holder further includes first and second supporters. The first and second supporters are mounted in traversal edge sides of the base plate and support the first and second longitudinal ends of the toner container, respectively.

35 Claims, 11 Drawing Sheets

APPARATUS FOR IMAGE FORMING AND IMAGE DEVELOPING WITH AN IMPROVEMENT OF TONER CONTAINER HOLDING

BACKGROUND OF THE INVENTION

1. Field of the Invention

The present invention relates to an apparatus for image forming and image developing, and more particularly to an apparatus for image forming and image developing which have an improvement of a toner container holding mechanism.

2. Discussion of the Background

Generally, an electrophotographic image forming apparatus such as a copying machine, a facsimile machine, a printer, a printing machine, and so on forms an image in a specific procedure of an electrophotographic method. That is, an electrostatic latent image is formed on an image carrying member such as a photosensitive drum and is subsequently developed with toner into a visual toner image. After that, the toner image is transferred and fixed onto a recording sheet. Thereby, an image is produced.

To develop an image, a development agent including the toner is used. There are two types of development agent: a one-component development agent having a main component of toner particles and a two-component development agent having two main components of toner particles and carrier particles. For both of the development agents, toner particles are contained in a toner container and are supplied in response to an amount of toner particles consumed in image forming.

FIG. 1 illustrates an exemplary toner container 10 which is configured to contain toner particles. The toner container 10 is formed in a cylindrical shape and includes an opening 10*a* and a spiral groove 10*b*. The opening 10*a* is formed at an outer end of a thin neck projected from the toner container 10, from which the toner particles are discharged. The spiral groove 10*b* is formed inner and outer circumferential surfaces of the toner container across one end to the other end of the toner container.

FIG. 2 illustrates an exemplary supporting mechanism 20 which includes a drive motor unit 21, a base plate 22, and a cap member 23. The drive motor unit 21 supports one end of the toner container 10 and drives it to rotate. When the toner container 10 is rotated, the toner particles container inside the toner container 10 are moved along the spiral groove in a rotational axis of the toner container 10. The base plate 22 and the cap member 23 are integrated in a single component. The base plate 22 includes a pair of rollers 22*a* for rotatably supporting the toner container 10 from below. The cap member 23 includes a closure 23*a* and a lock lever 23*b*. The closure 23*a* closes the opening 10*a* when the toner container 10 is set to a position in the supporting mechanism 20 such that one end of the toner container 10, having the opening 10*a*, is securely inserted to the cap member 23 after being placed on the base plate 22 and pushed towards the cap member 23. After that, the drive motor unit 21 is turned to a predetermined position to hold the other end of the toner container 10. After the toner container 10 is set to such a position, the lock lever 23*b* is turned to a lock position so that the toner container 10 is securely held by the supporting mechanism 20.

The cap member 23 includes a connecting member (not sown) which connects, through the closure 23*a*, the inside of the toner container 10 and a development mechanism of an image forming apparatus and transfers the toner particles in the toner container 10 to the development mechanism.

In the above-described mechanism, it is often not easy to cause the opening 10*a* to precisely meet its counter part of the closure 23*a* by pushing the toner container 10 from the other end thereof. In addition, it is also often caused that a vibration is generated at the end of the toner container 10 having the opening 10*a* due to a rotational torque given to the other end by the drive motor unit 21. Such a vibration may cause a problem in which the toner container 10 comes off from the closure 23*a*.

SUMMARY OF THE INVENTION

This patent specification describes a novel image forming apparatus which improves a mechanism for supporting a toner container. In one example, a novel image forming apparatus includes a toner container, an image development mechanism, and a toner container holder. The toner container has a longitudinal length with first and second longitudinal ends. The toner container is configured to contain toner, to be driven for rotation by a portion close to the second longitudinal end, and to move the toner in a longitudinal direction of the toner container while the toner container is driven for rotation. The image development mechanism is configured to develop an electrostatic latent image into a toner image with the toner contained in the toner container. The toner container holder is configured to hold the toner container. The toner container holder includes a base plate which is configured to form an upper-open space in which the toner container is inserted in a direction perpendicular to the longitudinal direction of the toner container. The toner container holder further includes first and second supporters. The first supporter includes a base pillar having a top portion and a bottom portion, is mounted by the bottom portion of the base pillar in a traversal edge side of the base plate, and is configured to support the first longitudinal end of the toner container. The second supporter is mounted in an opposite traversal edge side of the base plate and is configured to support the second longitudinal end of the toner container.

The first supporter may further include an arm-like extension member configured to have a free end extended to a place interfering an insertion of the toner container, to be pushed by an insertion of the toner container, and to support the toner container by pushing back with a resilience force of the arm-like extension member.

This patent specification further describes a novel image developing apparatus which improves a mechanism for supporting a toner container. In one example, a novel image developing apparatus includes an image development mechanism, a toner container driving mechanism, and a toner container holder. The image development mechanism is configured to develop an electrostatic latent image into a toner image with toner contained in a toner container. The toner container driving mechanism is configured to drive the toner container for rotation. The toner container holder is configured to hold the toner container and includes a based plate. The base plate is configured to form an upper-open space in which the toner container is inserted in a direction perpendicular to a longitudinal direction of the toner container. The toner container holder further includes first and second supporters. The first supporter includes a base pillar having a top portion and a bottom portion, is mounted by the bottom portion of the base pillar in a traversal edge side of the base plate, and is configured to support a first longitudinal end of the toner container. The second supporter is mounted in an opposite traversal edge side of the base plate and configured to support a second longitudinal end of the toner container.

This patent specification further describes a novel powder container holding apparatus which improves a mechanism for supporting a toner container. In one example, a novel powder container holding apparatus includes a base plate configured to form an upper-open space in which a powder container is inserted in a direction perpendicular to a longitudinal direction of the powder container. The powder container is configured to be rotated to move powder contained therein along the longitudinal direction of the powder container. The novel powder container further includes first and second supporters. The first supporter includes a top portion and a bottom portion, is mounted by the bottom portion in a traversal edge side of the base plate, and is configured to support a first longitudinal end of the powder container. The second supporter is mounted in an opposite traversal edge side of the base plate and is configured to support a second longitudinal end of the powder container.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
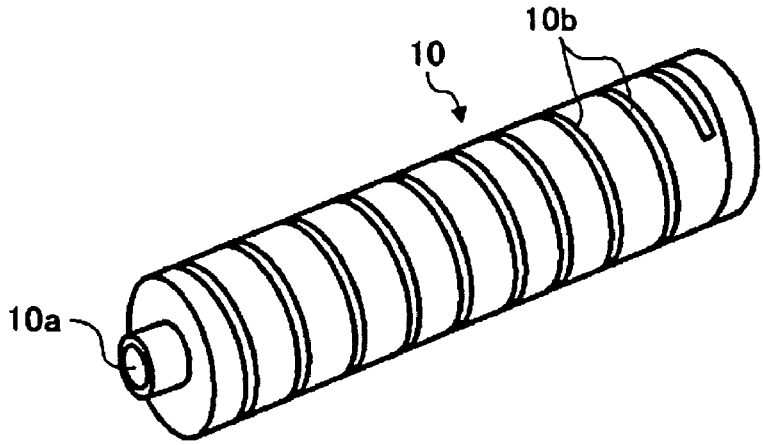
FIG. 1 PRIOR ART
FIG. 1 is a schematic illustration showing a background mechanism for holding a toner container.
Figure 2:
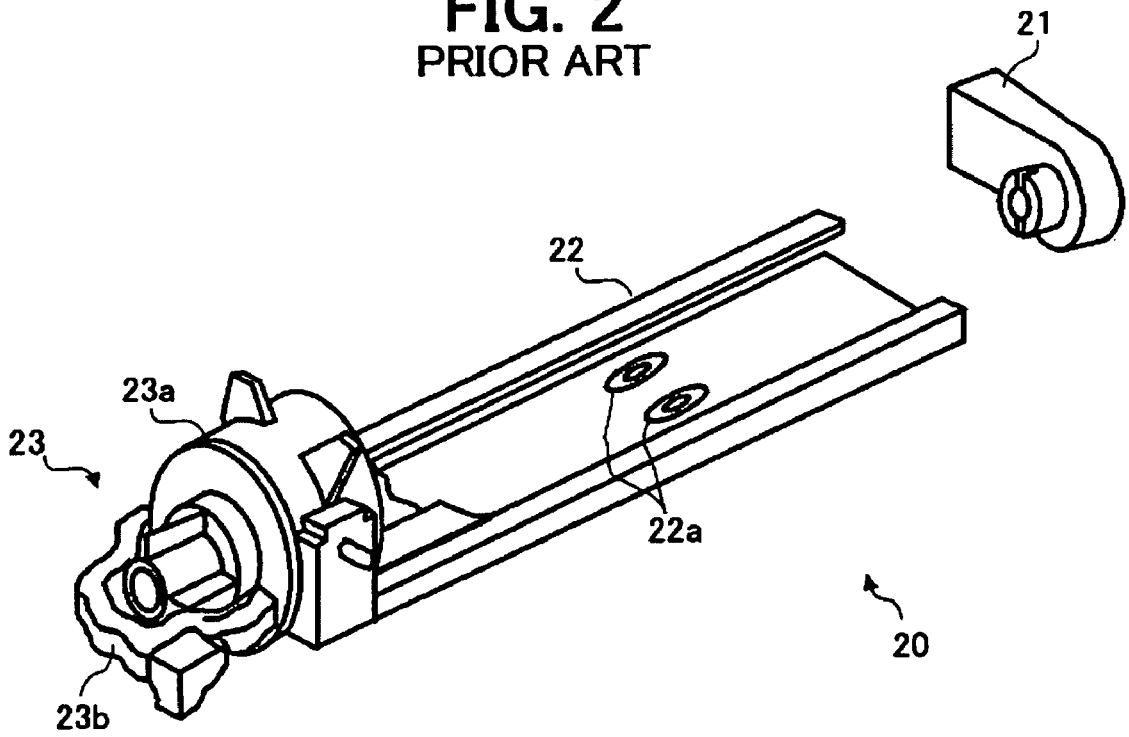
FIG. 2 PRIOR ART
FIG. 2 is a schematic illustration showing a supporting member for supporting the toner container included in the background mechanism.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, an electrophotographic image forming apparatus 1 according to an exemplary embodiment of the present invention is explained. The image forming apparatus 1 of FIG. 1 may be a color printer using a tandem-type image forming mechanism capable of producing a full-color image, a copying machine, a facsimile machine, a printing machine, or the like.

As illustrated in FIG. 1, the image forming apparatus 1 includes an optical unit 20, image forming units 21*y*, 21*c*, 21*m*, and 21*k*, a transfer unit 22, a manual sheet inserter 23, a sheet supply unit 24, a fixing unit 29, toner containers 31*y*, 31*c*, 31*m*, and 31*k*, an ejection tray portion 32, and a feed roller 33, a pair of registration rollers 34, a forward path 35, a path switch pawl 36, and a reverse path 37.

Figure 3:
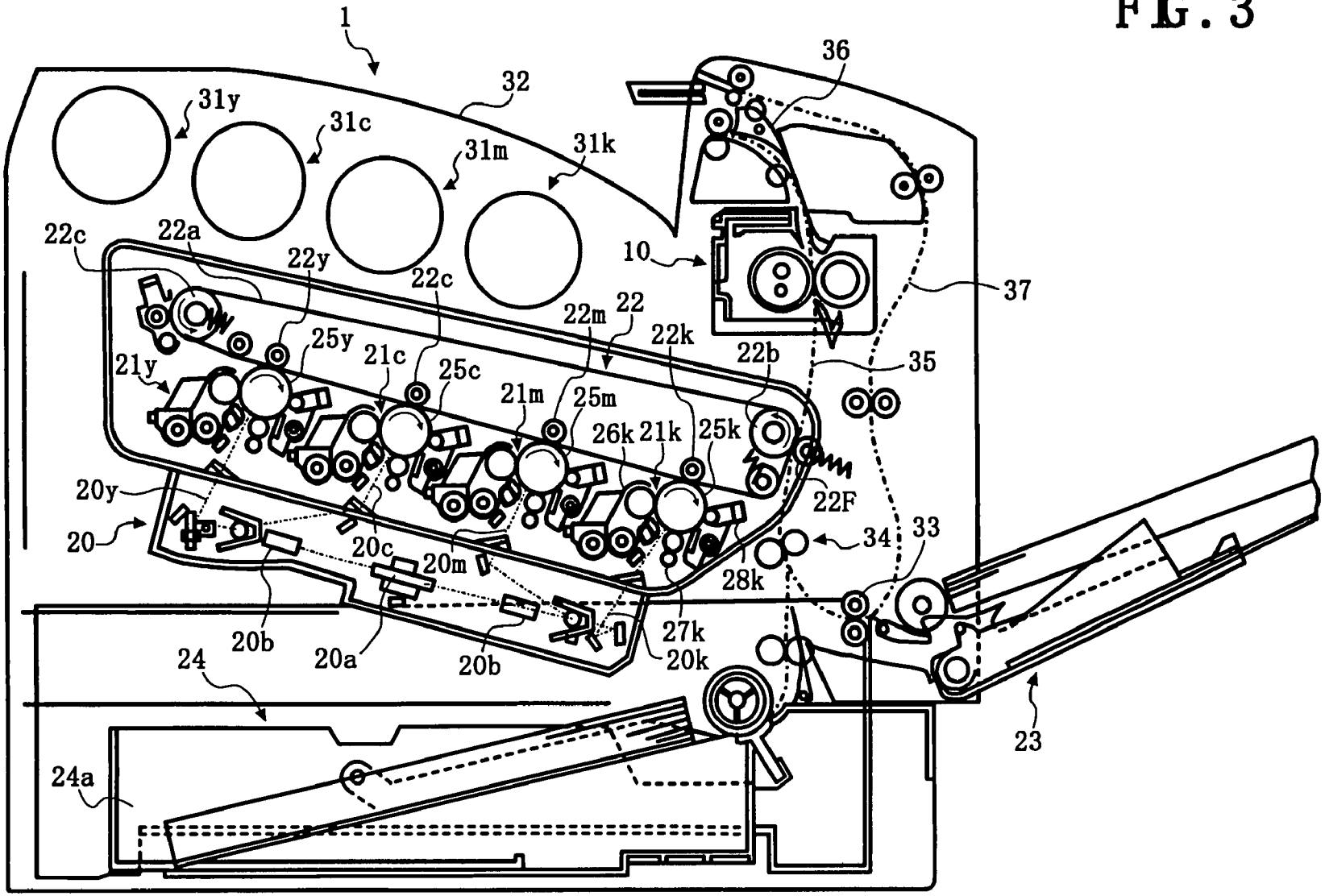
FIG. 3 is a schematic illustration of an image forming apparatus according to an exemplary embodiment of the present invention.

The optical unit 20 includes a multi-beam generating system which includes a polygon mirror 20*a* and a plurality of f-theta lenses 20*b*, and is configured to generate recording laser light beams 20*y*, 20*c*, 20*m*, and 20*k*. The image forming units 21*y*, 21*c*, 21*m*, and 21*k* are arranged in line and in parallel, as illustrated in FIG. 3, and are configured to form and develop images of yellow, cyan, magenta, and black color toners, respectively, in accordance with colors of an original image. The transfer unit 22 is arranged at a position in contact, from the above, with the image forming units 21*y*, 21*c*, 21*m*, and 21*k*. The manual sheet inserter 23 and the sheet supply unit 24 are selectively used, and each of them is configured to input a recording sheet into the image forming apparatus 1 toward the pair of registration rollers 34. The sheet supply unit 24 includes a sheet cassette 24*a* capable of containing a plurality of recording sheets. The pair of registration rollers 34 are configured to stop a recording sheet transported either from the manual sheet inserter 23 or the sheet supply unit 24 and to restart forwarding the recording sheet toward along the forward path 35 in synchronism with an image forming process performed by the image forming units 21*y*, 21*c*, 21*m*, and 21*k* and the transfer unit 22. The fixing unit 30 is configured to receive the recording sheet carrying an image of black or color toners thereon and to fix the image onto the recording sheet through a heat roller fixing operation. In general, this heat roller fixing operation conducts continuous processes of melting, softening, and osmosis by using a heat roller and a pressure roller arranged to contact each other, thereby fixing the image onto the recording sheet.

The image forming units 21*y*, 21, 21*m*, and 21*k* include photosensitive drums 25*y*, 25*c*, 25*m*, and 25*k*, respectively, and various other components. To avoid complexity in FIG. 3, components of the image forming unit 21*k* are representatively provided with requisite reference numerals, that is, the image forming unit 21*k* includes a development unit 26*k*, a charging unit 27*k*, and a cleaning unit 28*k*.

The transfer unit 22 includes a transfer belt 22*a*, a drive roller 22*b*, a driven roller 22*c*, primary transfer bias rollers 22*y*, 22*c*, 22*m*, and 22*k*, and a secondary transfer bias roller 22*f*. The transfer belt 22*a* is a looped belt extended among a plurality of rollers including the drive roller 22*b*, the driven roller 22*c*, and the primary transfer bias rollers 22*y*, 22*c*, 22*m*, and 22*k*. These primary transfer bias rollers 22*y*, 22*c*, 22*m*, and 22*k* are configured to apply a primary transfer bias having a polarity opposite to that of toner. They are arranged at positions opposite to corresponding photosensitive drums relative to the transfer belt 22*a*; for example, the primary transfer bias roller 22*k* faces the photosensitive drum 25*k* via the transfer belt 22*a*. With such a structure, the transfer unit 22 applies, in a case of forming a full-color image, the primary transfer bias having the opposite polarity relative to the toner's polarity through the primary transfer bias rollers 22*y*, 22*c*, 22*m*, and 22*k* to the transfer belt 22*a*. As a consequence, the toner images sequentially formed by the respective image forming units 21*y*, 21*c*, 21*m*, and 21*k* are sequentially transferred to the same position on the transfer belt 22*a*, thereby forming a single full-color image on the transfer belt 22*a*. The secondary transfer bias roller 22*f* is arranged at a position facing the drive roller 22*b* and is configured to transfer the single full-color image at a time from the transfer belt 22*a* to the recording sheet conveyed along the sheet path 35.

The above-described image forming apparatus 1 is capable of using a wide range of recording sheets including an ordinary copier paper, a relatively thick sheet such as a sheet for an overhead projector, a card, and a special sheet such as an envelope having a relatively greater thermal capacity.

The image forming units 21*y*, 21*c*, 21*m*, and 21*k*, which form and develop images of yellow, cyan, magenta, and black color toners, respectively, have structures similar to each other and operate in similar manners. Therefore, in the following description, the image forming unit 21*k* is explained as a representative for the other image forming units 21*y*, 21*c*, and 21*m*.

In the image forming unit 21*k* of FIG. 3, the charging unit 27, the development unit 26*k*, the cleaning unit 28*k* are arranged in this order along the rotational direction of the photosensitive drum 25*k*. The photosensitive drum 25*k* serves as an image carrying member for carrying an electrostatic latent image. The recording laser light beam 20*k* generated by the optical unit 20 passes through a space between the charging unit 27*k* and the development unit 26*k* and impinges on the photosensitive drum 25*k*.

Generally, the image carrying member is not limited to the photosensitive drum such as the photosensitive drums 25*y*, 25*c*, 25*m*, and 25*k* and can be formed in a belt-like shape.

For each color, most of the image forming related components surrounding the corresponding photosensitive drum are structured in a single unit called a process cartridge (not shown).

In the image forming apparatus 1 of FIG. 3, the transfer unit 22 is arranged in a slightly slant orientation and therefore has a reduced footprint.

An exemplary image forming operation using the image forming unit 21*k* with the black toner is explained. Other image forming units 21*y*, 21*c*, and 21*m* perform image forming operations in a manner similar to the operation of the image forming unit 21*k*.

The image forming operation first perform a charging process in which the photosensitive drum 25*k* is driven by a main motor (not shown) and is discharged by the charging unit 27*k* with an AC (alternating current) bias which includes no DC (direct current) element so that its surface is set to a reference voltage of about −50 volts.

Then, the photosensitive drum 25*k* is applied a DC bias superimposed by an AC bias, and the surface is evenly charged to a voltage substantially equal to the DC bias; at this time, the surface voltage is in a range of from approximately −500 volts to approximately −700 volts. A target charge potential charged at the surface is determined by each process controller for controlling the corresponding image forming operation.

After the charging process, the charged surface of the photosensitive drum 25*k* is subjected to a recording process. That is, the optical unit 20 causes a laser light source (not shown) included therein to emit the recording laser light beam 20*k* in accordance with a signal representing binary color data (i.e., black data) made based on digital image information. The recording laser light beam 20*k* emitted from the laser light source is controlled by a corresponding set of various optical elements, including cylindrical lens (not shown), the polygon mirror 20*a*, and the plurality of f-theta lenses 20*b*, and is finally caused to impinge on the evenly charged surface of the photosensitive drum 25*k*. When a place of the charged surface of the photosensitive drum 25*k* is exposed to the recording laser light beam 20*k*, the surface potential of the place becomes approximately −50 volts, thereby forming an electrostatic latent image in accordance with the digital image information on the surface of the photosensitive drum 25*k*.

The electrostatic latent image thus formed on the photosensitive drum 25*k* is then developed with the black toner by the development unit 26*k*, since in this case the color of the digital image information is black. For other colors, one of the yellow, cyan, and magenta color toners is used based on a complementary color relationship with the color of the digital color information whose color is one of the colors separated from the original image through color separation. The development unit 26*k* includes a development sleeve (not shown) for conveying toner to the surface of the photosensitive drum 25*k*. More specifically, the development sleeve is applied with a DC voltage in a range of from approximately −300 volts to approximately −500 volts to which an AC bias voltage is overlaid so as to develop a surface area of the photosensitive drum 25*k* where the potential is reduced by the exposure to the recording laser light beam 20*k* with the toner (i.e., the black toner) having a specific charge in a range of from approximately −20 μC/g to approximately −30 μC/g. Thereby, the electrostatic latent image is developed into a black toner image. Similar operations are sequentially performed for other colors, and yellow, cyan, and magenta color toner images are formed accordingly.

Then, the primary transfer bias rollers 22*y*, 22*c*, 22*m*, and 22*k*, facing the photosensitive drums 25*y*, 25*c*, 25*m*, and 25*k*, respectively, relative to the transfer belt 22*a*, are applied with a bias voltage having the reverse polarity to that of the toners so that the toner images developed are electrostatically transferred onto the transfer belt 22*a* at the same position, thereby forming a full-colored toner image made of overlaid toner images. The secondary transfer bias roller 22*f* transfers the full-colored toner image carried on the transfer belt 22*a* to the recording sheet which is conveyed through the forward path 35 by the pair of registration rollers 34 in synchronism with the advance of the full-colored toner image carried by the transfer belt 22*a*.

After receiving the full-colored toner image from the transfer belt 22*a*, the recording sheet is separated from the transfer belt 22*a* by the action of curvature separation and is further conveyed to the fixing unit 30 conducting the fixing process. When the recording sheet reaches the fixing unit 30, the recording sheet passes through the fixing nip formed between the heat roller and the pressure roller so that the full-colored toner image is fixed onto the recording sheet. Then, the recording sheet is guided to the ejection tray portion 32 which is part of a housing of the image forming apparatus 1.

The image forming apparatus 1 of FIG. 3 is capable of performing not only a simplex image forming for forming an image on one side of recording sheet but also a duplex image forming for forming images on both sides of recording sheet. In the duplex image forming mode, the path switch pawl 36 is moved to a position so that the recording sheet after the fixing process on one side of the recording sheet is conveyed to a standby area and is subsequently reversed along the reverse path 37 towards the feed roller 33. Then, the recording sheet is again fed to the pair of registration rollers 34 via the feed roller 33 to face the transfer belt 22*a* with the other side of the recording sheet. Thereby, the next toner image formed on the transfer belt 22*a* is transferred onto the other side of the recording sheet by the secondary transfer bias roller 22*f*. As illustrated in FIG. 3, the path switch pawl 36 is arranged at a rear side of the fixing unit 30 and the feed roller 33 combines the functions for feeding such reversed recording sheet and those inserted from the manual sheet inserter 23.

The toner containers 31*y*, 31*c*, 31*m*, and 31*k* are connected to the development units 21*y*, 21*c*, 21*m*, and 21*b*, respectively, with respective toner supply pipes (not shown) so as to supply the respective color toners to the respective development units 21*y*, 21*c*, 21*m*, and 21*b*.

Figure 4:
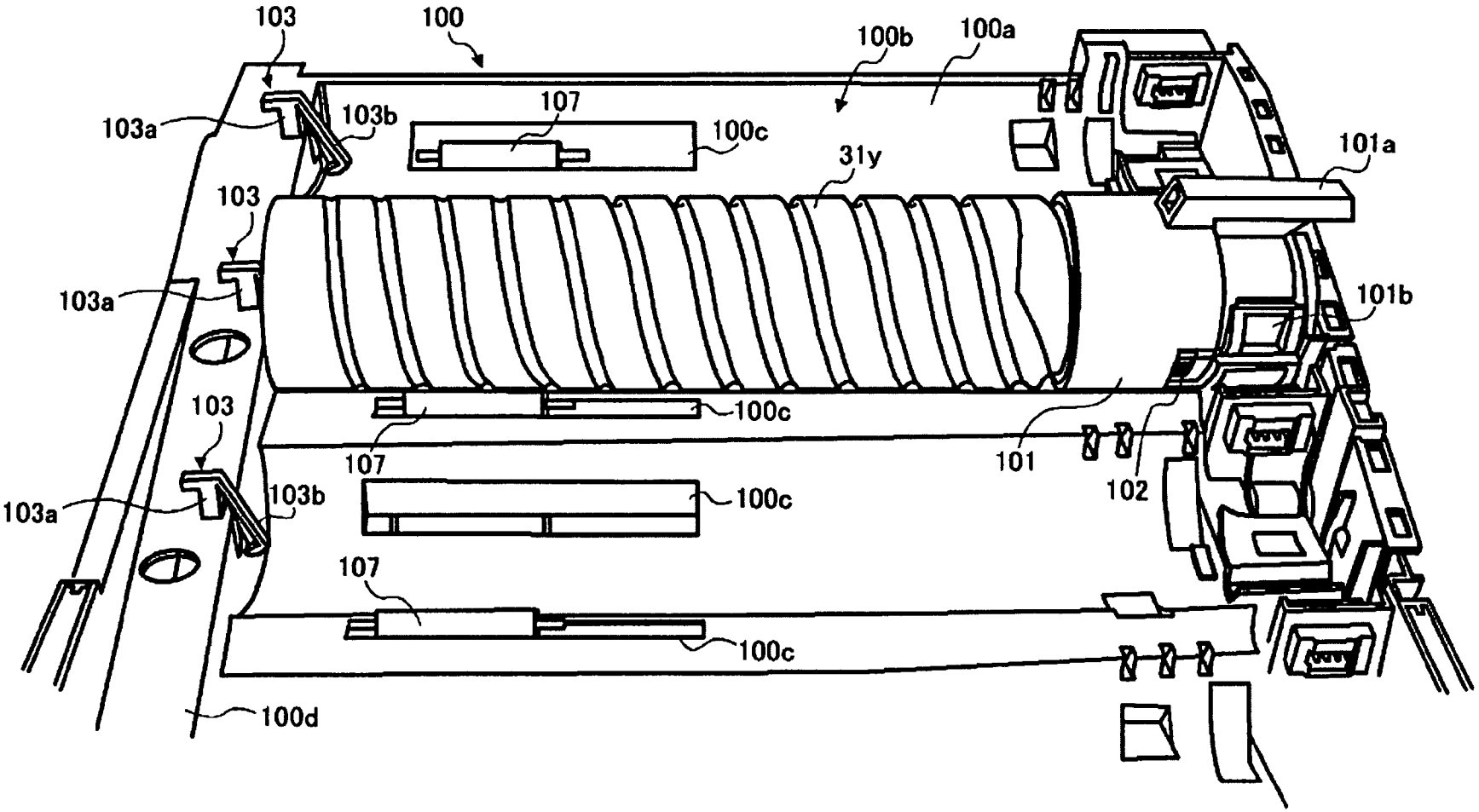
FIG. 4 is a schematic illustration of a toner container supporter included in the image forming apparatus of FIG. 3 in which a toner container for black, for example, is placed.

Referring to FIG. 4, an exemplary toner container supporter 100 included in the image forming apparatus 1 is explained. FIG. 4 illustrates a part of the toner container supporter 100 and the toner container 31*y*, as an example. The description for the toner container 31*y* can also be applied to other toner containers 31*c*, 31*m*, and 31*b*. The toner container supporter 100 includes a base plate 100*a* which forms a space 100*b* having an upward open shape, in which the toner container 31*y* is placed from above in a manner its longitudinal direction is made horizontal. The base plate 100*a* includes a plurality of openings 100*c* from which respective rollers 107 are exposed, which are explained in descriptions below. The toner container supporter 100 further includes a side plate 100*d* and stoppers 103. The stoppers 103 are made of a flexible material. Each stopper 103 includes a base pillar 103*a* and an extension portion 103*b*, and is fixed to the side plate 100*d* such that which the extension portion 103*b* holds with tension the toner container 31*y* at a first longitudinal end 104 thereof. The base pillar 103*a* and the extension portion 103*b* are formed in a single piece as the stopper 103.

As illustrated in FIG. 4, the toner container 31*y* includes a ring member 101 mounted to the outer surface of the toner container 31*y* at a second longitudinal end thereof which is opposite to the first longitudinal end 104 held by the stopper 103. The ring member 101 includes a grip portion 101*a* which is formed in one piece with the ring member 101 for being held at an installation and a removal of the toner container 31*y*.

The toner container 31*y* also includes a driven gear 102 arranged inside the ring member 101 and formed in one piece with the toner container 31*y*.

The toner container 31*y* has a spiral groove in an inside surface by which the toner contained inside is moved in a direction perpendicular to the rotation direction of the toner container 31*y*.

The ring member 101 of the toner container 31*y* includes a toner discharging opening 101*b* which is arranged at a position near the second longitudinal end and circumferentially away from the grip portion 101*a* by 90 degrees so that when the grip portion 101*a* is turned by 90 degrees the toner discharging opening 101*b* is also turned by 90 degrees to face down a toner receiving opening (not shown) provided to the toner container supporter 100. Thus, by the grip portion 101*a* is turned by 90 degrees, the toner discharging opening 101*b* is connected to the toner receiving opening of the toner container supporter 100.

Figure 5:
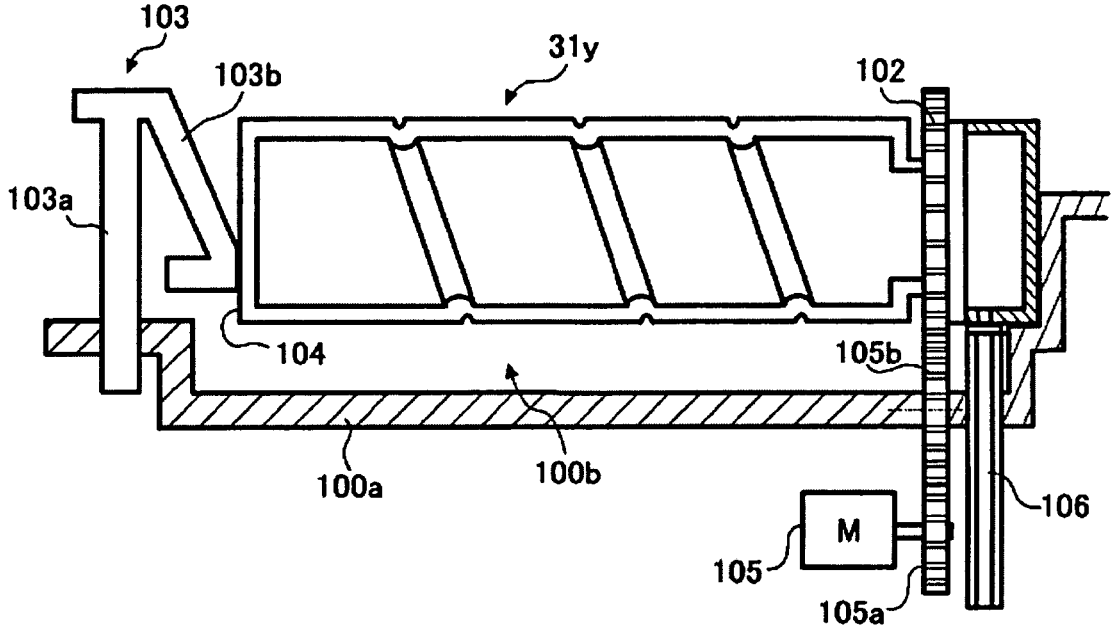
FIG. 5 is a schematic illustration of an exemplary structure for supporting the toner container.

When the toner container 31*y* is placed in the space 100*b*, the toner container 31*y* needs to be settled firmly and stably at a predetermined position. This mechanism is explained with reference to FIG. 5, illustrating a state in which the toner container 31*y* is placed in the space 100*b* and is held by the extension portion 103*b* of the stopper 103. As illustrated in FIG. 5, the base pillar 103*a* has a T-like shape and is fixed to the base plate 100*a*.

The extension portion 103*b* is extended from a top of the stopper 103 with an angle towards an approximate center of the first longitudinal end 104 of the toner container 31*y* and has an end which engages with the first longitudinal end 104 of the toner container 31*y* with pressure.

The toner container 31*y* is driven for rotation by a motor 105 via a drive gear 105*a* and an idle gear 105*b*. As described above, the toner container 31*y* has the spiral groove in its inside surface and when the toner container 31*y* is rotated the toner contained inside is moved along the groove towards the toner discharging opening 101*b* near the second longitudinal end. Then, the toner is conveyed to the corresponding development unit through a toner transfer pipe 106.

At least one of the stopper 103 and the corresponding toner container includes a polyacetal resin which has a relatively low friction coefficient. Thus, it becomes possible to reduce a rubbing friction caused between the stopper and the toner container at an installation of the toner container.

To install the toner container 31*y* to the toner container supporter 100 having the above-described structure, the toner container 31*y* is placed down into the space 101*b* from above and, during the placement, an edge portion of the first longitudinal end 104 of the toner container 31*y* is guided along the extension portion 103*b* until it is settled.

On the other hand, the extension portion 103*b* extended to a position where it interferes the insertion of the toner container 31*y* is flexibly deformed to a position where it does not interfere but firmly holds the toner container 31*y* as the toner container 31*y* is downwardly and forcibly inserted to its operational position. When the toner container 31*y* is settled at a predetermined position, the extension portion 103*b* pushes with a resilient force thereof the first longitudinal end 104 of the toner container 31*y* in the longitudinal direction to hold it tightly and stably.

Thus, according to the present embodiment, the stopper 103 has the resilient force which is activated to continuously contact the first longitudinal end 104 of the toner container 31*y* as the toner container 31*y* is inserted to its operational position along the extension portion 103*b*. Thereby, it becomes possible that the toner container 31*y* is smoothly guided to and settled at its operational position.

Figure 6A:
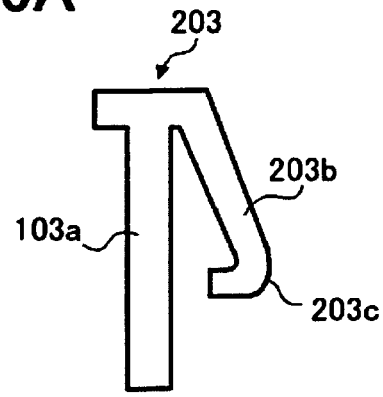
FIGS. 6A and 6B are schematic illustrations of a stopper for stopping the toner container.
Figure 6B:
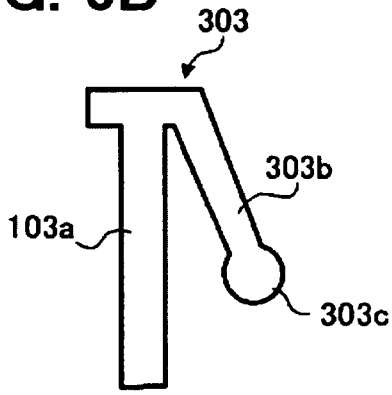

FIGS. 6A and 6B illustrate other exemplary stoppers 203 and 303, respectively. The stopper 203 of FIG. 6A is similar to the stopper 103, except for an extension portion 203*b* which has a curved end 203*c*. With this configuration, the extension portion 203*b* contacts the first longitudinal end 104 of the toner container 31*y* with a minimal contact area so as to be able to minimize a rubbing friction caused between the stopper and the toner container at an installation of the toner container. It becomes also possible with this configuration to eliminate an accidental event which may be caused with the stopper 103 such that the first longitudinal end 104 of the toner container 31*y* is caught by the edge of the extension portion 103*b*. The stopper 303 of FIG. 6B is similar to the stopper 103, except for an extension portion 303*b* which has a round end 303*c*. With this configuration, the stopper 303 operates with the same effect as the stopper 203 does.

Figure 7:
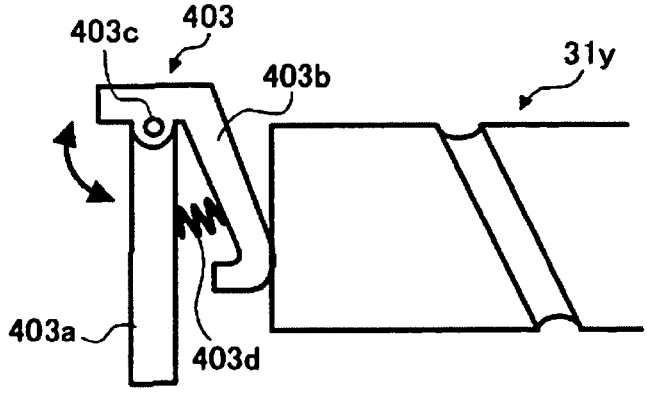
FIG. 7 is a schematic illustration of another stopper.

FIG. 7 illustrates further another exemplary stopper 403 which includes a straight pillar 403*a*, a leverage extension portion 403*b*, a pin 403*c*, and a coil spring 403*d*. The leverage extension portion 403*b* is movably mounted to the straight pillar 403*a* with the pin 403*c*, and the leverage extension portion 403 is pressed by the coil spring 403*d* towards the first longitudinal end 104 of the toner container 31*y*. With this structure, it becomes possible to adjust the spring force of the coil spring 403*d* to optimize a rubbing friction caused between the stopper and the toner container at an installation of the toner container. In addition, with this structure, the operator can easily feel a difference between resistances at a time of installing along the leverage extension portion 403*c* and at a time of settlement. That is, with such a tangible difference, the operator can easily realize a completion of installation.

Figure 8:
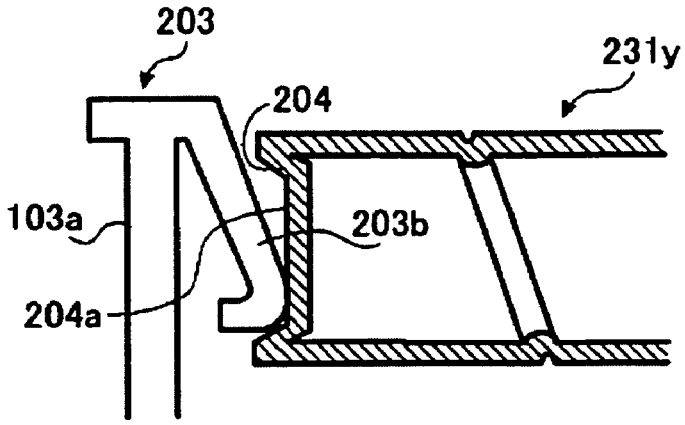
FIG. 8 is a schematic illustration of a modified toner container held by the stopper of FIG. 7.
Figure 9:
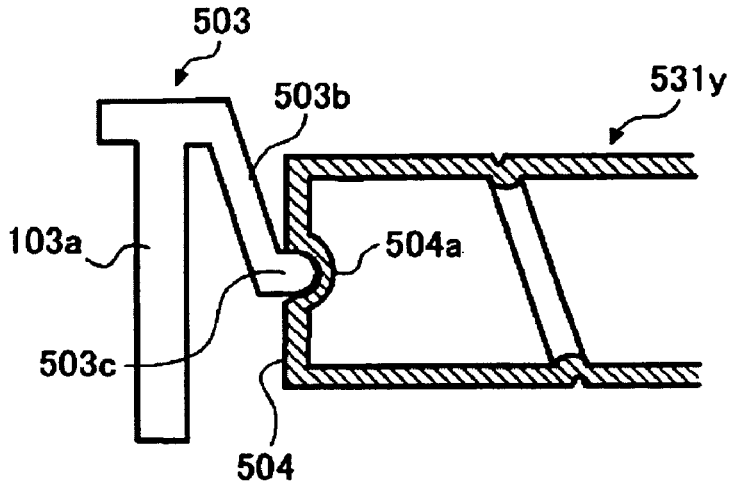
FIGS. 9 and 10 are schematic illustrations of other stoppers having different shapes.
Figure 10:
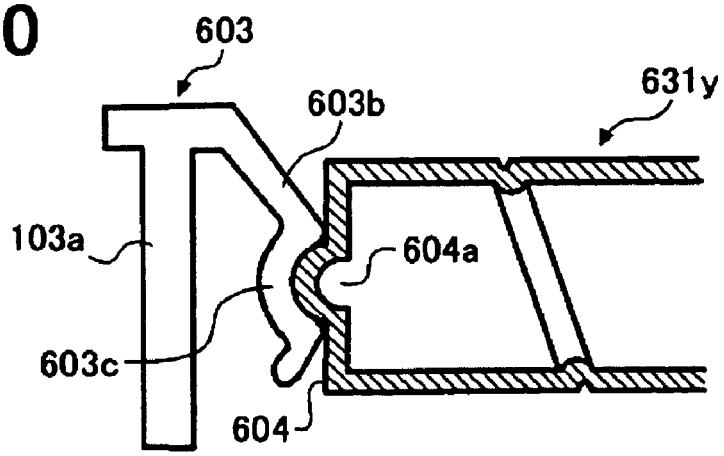
Figure 11A:
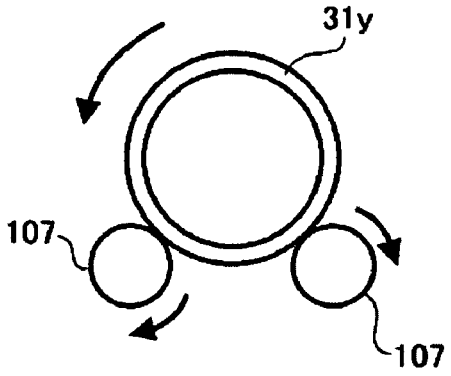
FIGS. 11A and 11B are schematic illustrations of an exemplary under-support of the toner container.
Figure 11B:
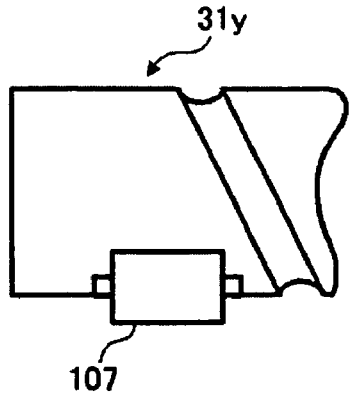

Referring to FIGS. 8–10, exemplary ways of engagement between the toner container and the stopper are explained. As illustrated in FIG. 8, a toner container 231*y* includes a first longitudinal end 204 which has a hollow 204*a* whose circumferential inner edge surface has a relatively small angle relative to a horizontal plane. The extension portion 203*b* of the stopper 203 has a flat surface following the curbed end 203*c* and is extended to the circumferential inner edge surface of the hollow 204*a* so that the flat surface of the extension portion 203*b* contacts the circumferential inner edge surface of the hollow 204*a*. This structure avoids an unexpected event in which the first longitudinal end 204 of the toner container 231*y* is disengaged from the extension portion 203*b*. Such an unexpected event may be caused by the action of rotational torque applied to the toner container 231*y* by the motor 105 through the drive gear 105*a* and the idle gear 105*b*. Such an unexpected event may also be caused by an erroneous operation by the operator to remove the toner container 231*y*.

FIG. 9 illustrates a toner container 531*y* and a stopper 503. The toner container 531*y* includes a first longitudinal end 504 having a semiround hollow 504*a* which is arranged at a rotational center of the toner container 531*y*. The stopper 503 includes an extension portion 503*b* having a semiround bent-end 503*c*. As illustrated in FIG. 9, when the toner container 531*y* is installed, the toner container 531*y* allows the stopper 503 to be engaged by its semiround bent-end 503*c* with the semiround hollow 504*a* of the toner container 531*y* so that the toner container 531*y* is rotatably supported.

FIG. 10 illustrates a toner container 631*y* and a stopper 603. The toner container 631*y* includes a first longitudinal end 604 having a semiround projection 604*a* which is arranged at a rotational center of the toner container 631*y*. The stopper 603 includes an extension portion 603*b* having a semiround end 603*c*. As illustrated in FIG. 10, when the toner container 631*y* is installed, the toner container 631*y* allows the stopper 603 to be engaged by its semiround end 603*c* with the semiround projection 604*a* of the toner container 631*y* so that the toner container 631*y* is rotatably supported.

These structures of FIGS. 9 and 10 avoid an unexpected event in which the first longitudinal end of the toner container is disengaged from the extension portion. Such an unexpected event may be caused by the action of rotational torque applied to the toner container by the motor through the drive gear and the idle gear. Such an unexpected event may also be caused by an erroneous operation by the operator to remove the toner container. In addition, since the extension portion of the stopper holds the toner container at the center of the toner container, the toner container can stably be rotated without developing an undesirable deflection.

Referring to FIGS. 8A to 11, exemplary ways of stabling the toner container at rotation is explained. As illustrated in FIGS. 11A and 11B and also FIG. 4, the toner container 31*y* is supported by the rollers 107. The rollers 107 are projected from the openings 100*c* which are formed in the base plate 100*a* and near the first longitudinal end 104.

Figure 12A:
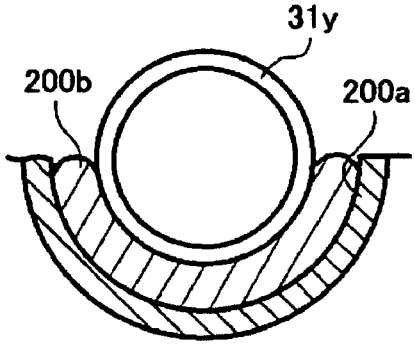
FIGS. 12A and 12B are schematic illustrations of another exemplary under-support of the toner container.
Figure 12B:
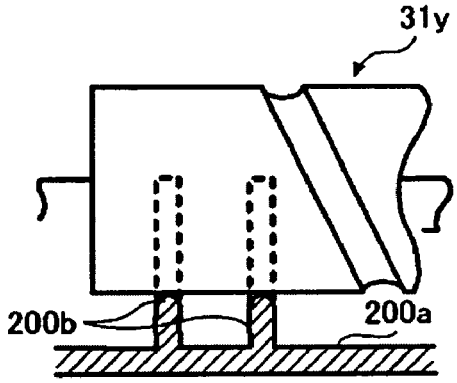

FIGS. 12A and 12B illustrate the toner container 31*y* supported by a base plate 200*a* with a pair of ring portions 200*b*. The pair of ring portions 200*b* of the base plate 200*a* are formed near the first longitudinal end 104 in a semiround shape to support the toner container 31*y* with minimal contacting areas.

Figure 13A:
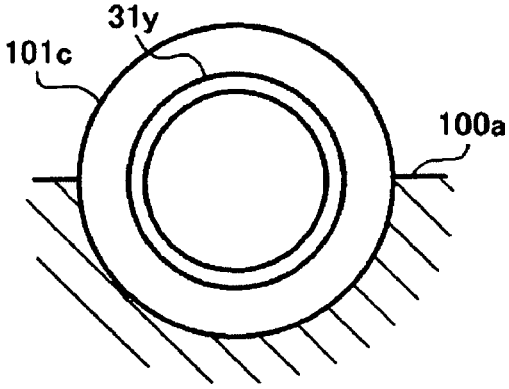
FIGS. 13A and 13B are schematic illustrations of another exemplary under-support of the toner container.
Figure 13B:
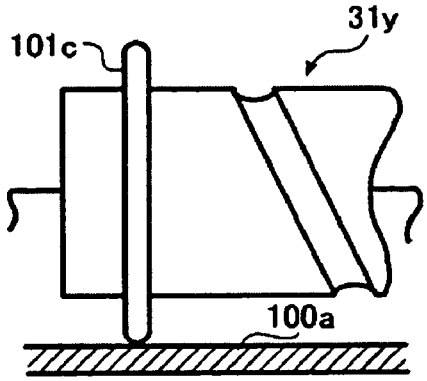

FIGS. 13A and 13B illustrate the toner container 31*y* provided with a ring plate 101*c* which contacts the base plate 100*a*.

With these structures described above, the toner container can stably be rotated without developing an undesirable deflection.

The toner container supporter illustrated in FIGS. 11A and 11B, 12A and 12B, and 13A and 13B also includes one of the stoppers described above to hold the toner container.

Figure 14:
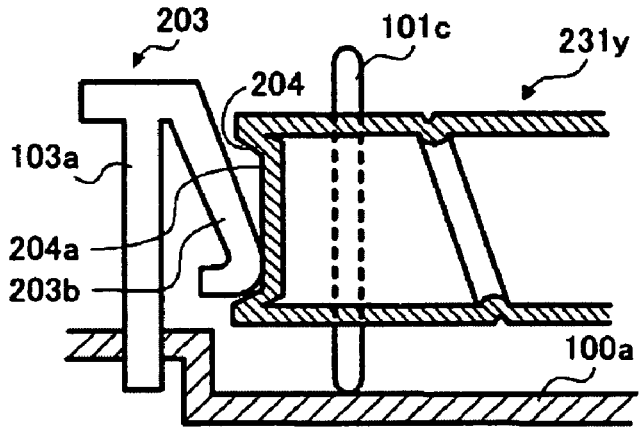
FIG. 14 is an schematic illustration of an exemplary support of the toner container using the stopper of FIG. 6A and the under-support of FIG. 13A.

FIG. 14 illustrates a structure in which the toner container 31*y* having the ring plate 101*c* is held for rotation by the stopper 203 of FIG. 8. With this structure, it becomes possible to rotate the toner container in a stable manner without developing an undesirable deflection and to avoid an unexpected disengagement of the first longitudinal end of the toner container from the extension portion due to an erroneous operation to remove the toner container by the operator, for example.

Figure 15A:
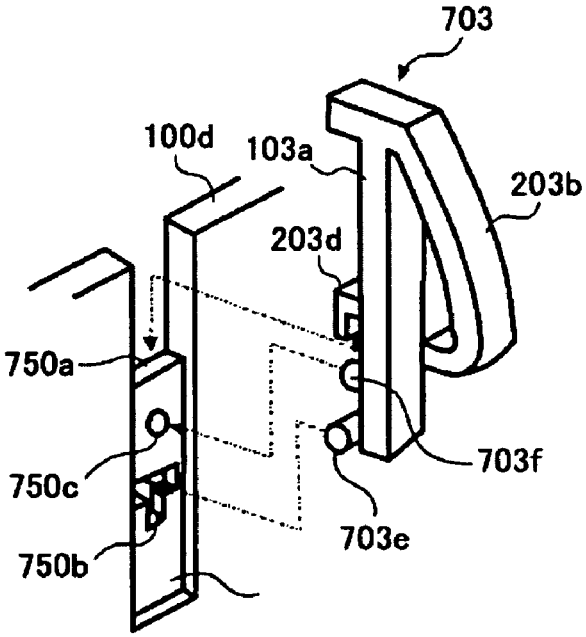
FIGS. 15A and 15B are schematic illustrations of an exemplary mechanism for fitting a toner container stopper to a side plate of the base plate.
Figure 15B:
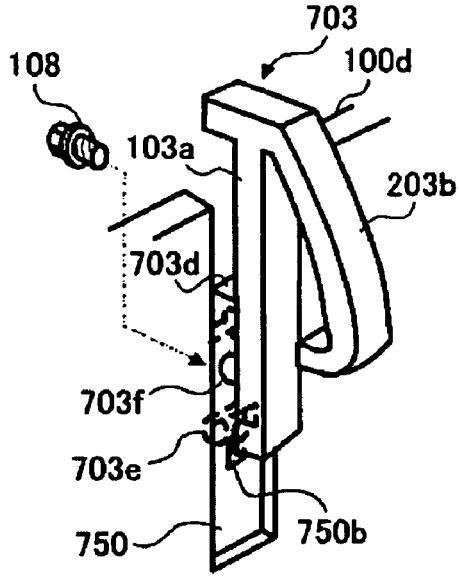

Referring to FIGS. 15A and 15B, another exemplary mechanism for holding the toner container 31*y* is explained below. This mechanism uses a stopper 703. The stopper 703 of FIG. 15A is similar to the stopper 203 of FIG. 6A, except for first, second, and third fastening members 703*d*, 703*e*, and 703*f* which are mounted to a surface of the base pillar 103*a*, facing the side plate 100*d*. The first fastening member 703*d* has an L-like shape forming a downward-open space together with the surface of the base pillar 703*a*, and the second fastening member 703*e* has a T-like-pin shape having a leg portion (not shown) standing on the surface of the base pillar 103*a*. The third fastening member 703*f* has a pin shape standing between the first and second fastening members 703*d* and 703*e* on the base pillar 103*a*, as illustrated in FIG. 15A.

As also illustrated in FIG. 15A, the side plate 103*d* has a relatively thin thickness and includes a counter-fastening portion 750. This counter-fastening portion 750 includes top edge 750*a*, a T-like shaped hole 750*b*, and a vertically-oval-shaped hole 750*c* which are arranged at positions in a surface of the counter-fastening portion 750 to engage with the second and third fastening members 703*e* and 703*f*, respectively. More specifically, as illustrated in FIG. 15B, as a first step, the stopper 703 is attached to the counter-fastening portion 750 such that the first, second, and third fastening members 703*d*, 703*e*, and 703*f* contact the top edge 750*a*, the T-like shaped hole 750*b*, and the vertically-oval-shaped hole 750*c*, respectively. Then, the stopper 703 is pushed downward, so that the top edge 750*a* enters into the downward-open space of the first fastening member 703*d*, the leg portion of the second fastening member 703*e* slips into a leg portion of the T-like shaped hole 750*b*, and the third fastening member 703*f* slides down in and along the vertically-oval-shaped hole 750*c*. Thereby, the stopper 703 is firmly engaged with the counter-fastening portion 750, that is, with the side plate 100*d*. The stopper 703 is easily removed by following the above-described installation step in reverse.

Figure 16A:
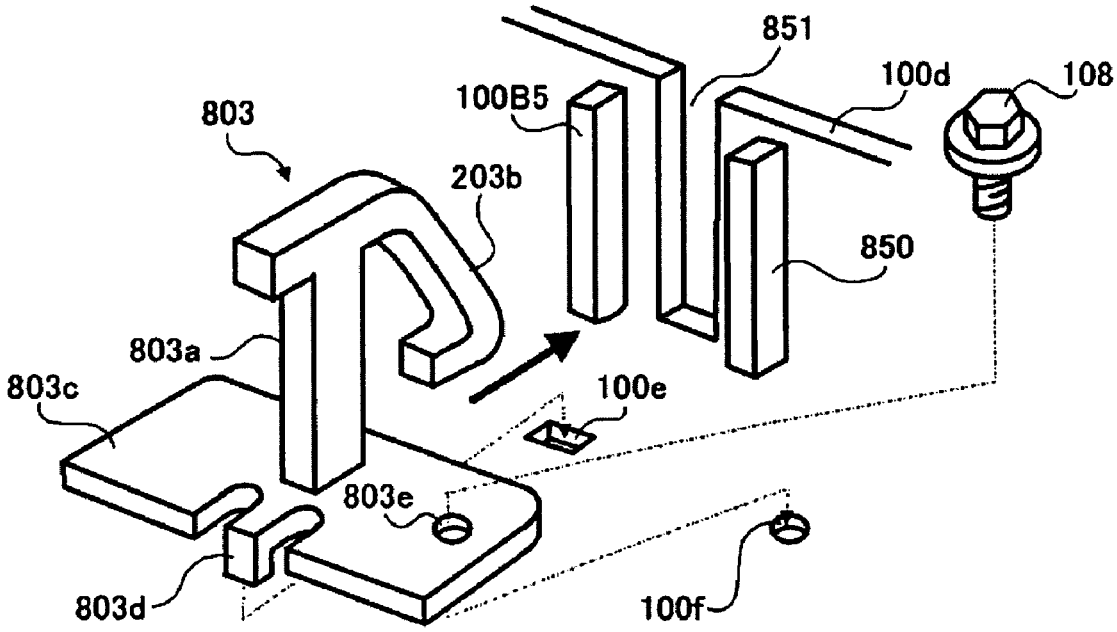
FIGS. 16A and 16B are schematic illustrations of another exemplary mechanism for fitting a toner container stopper to a side plate of the base plate.
Figure 16B:
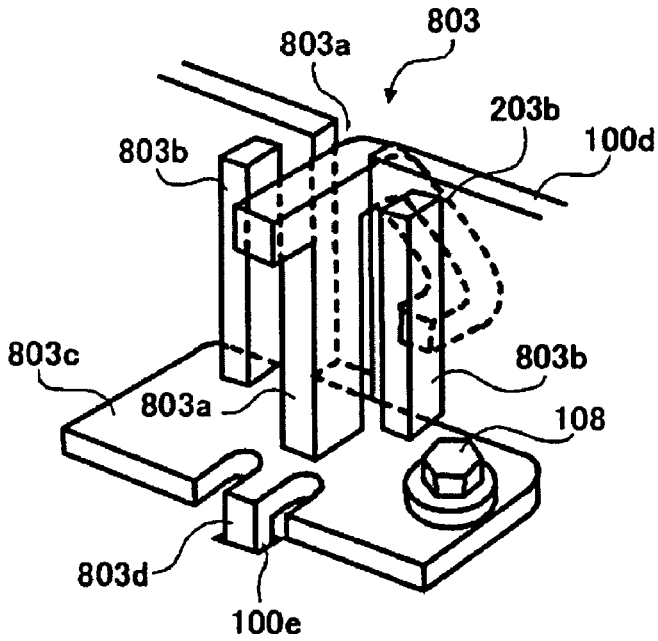

Referring to FIGS. 16A and 16B, another exemplary mechanism for holding the toner container 31*y* is explained below. This mechanism uses a stopper 803. The stopper 803 of FIG. 16A is similar to the stopper 203 of FIG. 6A, except for a base pillar 803*a*. The base pillar 803*a* includes a bottom plate 803*c* which has an upper surface on which the base pillar 803*a* stands, as illustrated in FIG. 16A, and the bottom plate 803*c* includes a hook 803*d* and a hole 803*e*.

As also illustrated in FIG. 16A, the side plate 100*d* of the toner container supporter 100 includes two rectangular bars 850 arranged at an outer surface of the side plate 100*d*, opposite to the toner container 31*y*, and a rectangular slit 851 which is arranged between the rectangular bars 850. To install this mechanism, the stepper 803 is placed at a position opposite to the toner container 31*y* relative to the side place 100*d*, as illustrated in FIG. 16A. Then, the stopper 803 is slid towards the side plate 100*d* so that the extension portion 203*b* of the stopper 803 is inserted into until the top leading edge of the bottom plate 803*c* contacts the surface of the side plate 100*d* under the rectangular bars 850. Consequently, the extension portion 203*b* of the stopper 803 is projected from the rectangular slit 851 of the side plate 100*d* and the hook 803*d* of the bottom plate 803*c* is inserted into a hole 100*e* of the base plate 100*a*. After that, the bottom plate 803*c* and the base plate 100*a* are fixed by a bolt 108 through the hole 80*ee* and a hole 100*f* of the base plate 100*a*, as illustrated in FIG. 16B.

With this structure, the stopper 803 functions to stop and hold the toner container 31*y* in a manner similar to the stopper 203 of FIG. 6A. That is, the extension portion 203*b* of the stopper 803 is projected from the side plate 100*d* to the position where the extension portion 203*b* interferes the insertion of the toner container 31*y* and is flexibly deformed to a position where it does not interfere but firmly holds the toner container 31*y* as the toner container 31*y* is downwardly and forcibly inserted to its operational position.

Furthermore, with this structure, the rectangular bars 850 which hold the bottom plate 803*c* from above and therefore does not allow an upward movement of the stopper 803 which may mistakenly be caused by operators.

Thus, according to the present embodiment, the stopper 803 is detachably mounted to the toner container supporter 100 by the engagements between the hook 803*d* and the hole 100*e* and between the bottom plate 803*c* and the base plate 100*a* using the bolt 108 through the hole 803*e* and the hole 100*f*, by which the stopper 803 is accurately positioned relative to the toner container 31*y* without providing any extra positioning mechanism.

Figure 17:
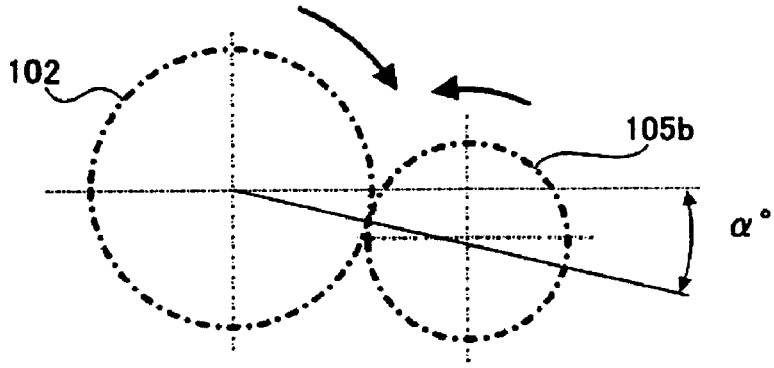
FIG. 17 is a schematic illustration illustrating a relationship between a driven gear mounted to the toner container and an idle gear transmitting a driving force to the driven gear.

FIG. 17 illustrates a preferable relationship between the driven gear 102 and the idle gear 105*b* (also see FIG. 5). As illustrated in FIG. 17, the driven gear 102 and the idle gear 105*b* are configured to rotate in predetermined directions, as indicated with arrows in FIG. 17. As a result, the idle gear 105*b* gives a rotational torque to the driven gear 102 at a point contacting each other and consequently a downward force is generated downwardly at the axis of the driven gear 102. Such a downward force suppresses an undesirable upward movement of the toner container 31*y*. This downward force relates to the position of the axis of the idle gear 105*b*. In other words, the downward force becomes greater when the idle gear 105*b* is placed such that the axis thereof is below the axis of the driven gear 102 but smaller when the idle gear 105*b* is placed such that the axis thereof is above the axis of the driven gear 102. Therefore, it is preferable to place the idle gear 105*b* such that the axis of the idle gear 105*b* is below the axis of the driven gear 102.

As described above, according to the present embodiment, it becomes possible to secure that the toner container 31*y* is prevented from upward disengagement simply by regulating the rotational directions of the idle gear 105*b* and the driven gear 102.

Figure 18A:
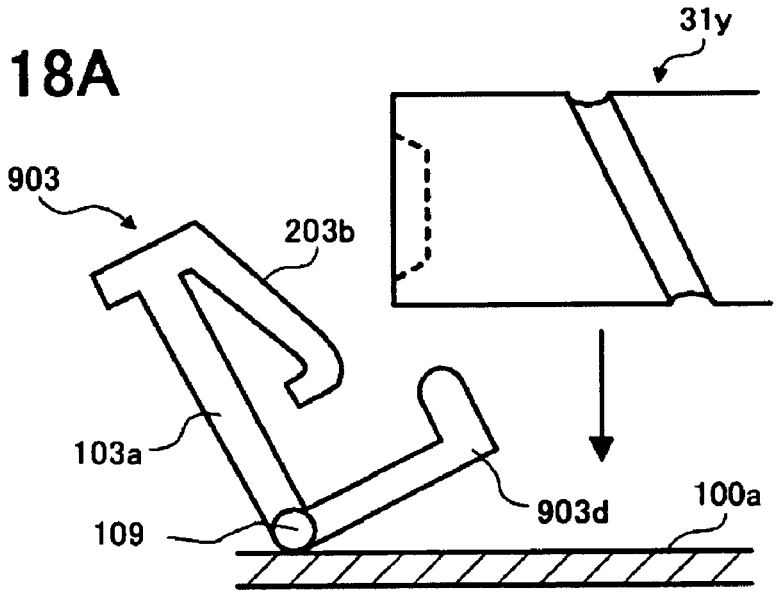
FIGS. 18A and 18B are schematic illustrations of another exemplary support of the toner container using another toner container stopper.
Figure 18B:
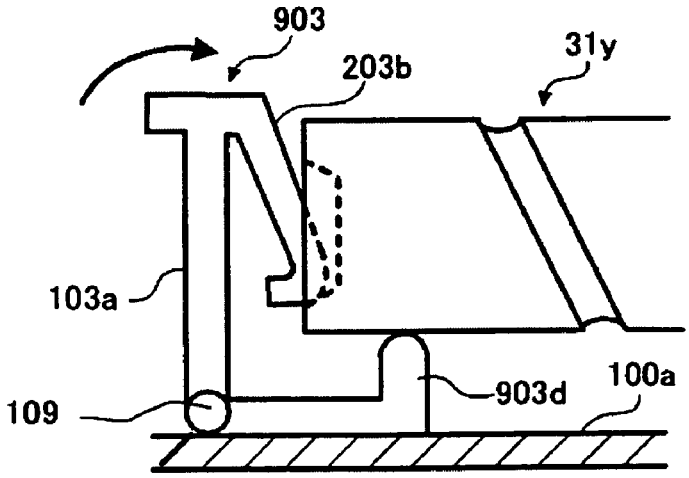

Referring to FIGS. 18A and 18B, another exemplary mechanism for holding the toner container 31*y* is explained below. This mechanism uses a stopper 903. The stopper 903 of FIG. 18A is similar to the stopper 203 of FIG. 6A, except for a base pillar 903*a*. The base pillar 903*a* include a bottom leg 903*d* which has an L-like shape, as illustrated in FIG. 18A. The bottom leg 903*d* has one end at which the stopper 903 is rotatably fixed with a rotary pin 109 to the base plate 100*a* of the toner container supporter 100. The other end of the bottom leg 903*d* is angled and is configured to contact and support the circumferential surface of the toner container 31*y* from below when the toner container 31*y* is inserted and the stopper 903 is turned about the rotary pin 109, as illustrated in FIG. 18B.

This mechanism can achieve both reduction of frictional resistance from the extensional portion 203*b* when the toner container 31*y* is inserted to its operational position and securing the toner container 31*y* at its operational position after the toner container 31*y* is installed to the operational position.

Figure 19:
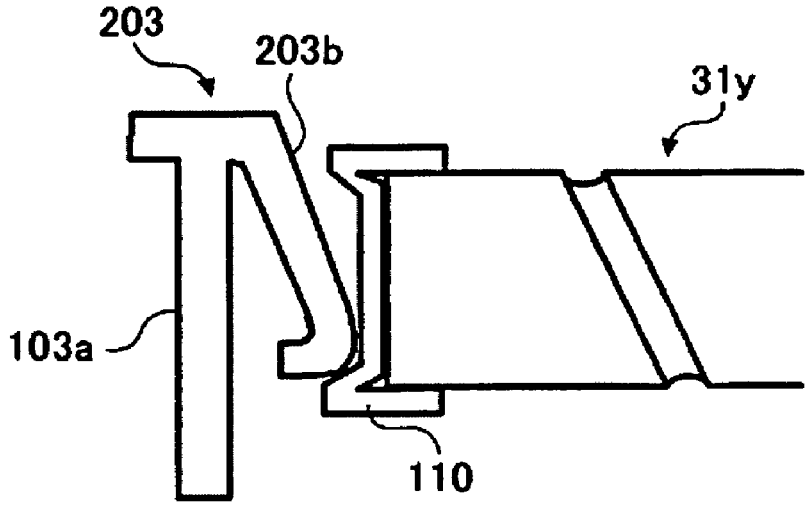
FIG. 19 is a schematic illustration of an exemplary mechanism for protecting a bottom of the toner container using a cap member.

Referring to FIG. 19, an exemplary structure of increasing a durability of the first longitudinal end 104 of the toner container 31*y*, which is derived based on the structures illustrated in FIGS. 5 and 8. As illustrated in FIG. 19, the toner container 31*y* is provided with a cap member 110 to cover the first longitudinal end 104. The cap member 110 has an M-like shape tilted by 90 degrees and is installed to the first longitudinal end 104 of the toner container 31*y* such that the top hollow of the cap member 110 contacts the extensional portion 203*b*, as illustrated in FIG. 19. Therefore, the extensional portion 203*b* of the stopper 203 does not directly rub the first longitudinal end 104 of the toner container 31*y* during both the installation and the rotation of the toner container 31*y*, so that the durability of the toner container 31*y* will be increased. When the top hollow of the cap member 110 is worn by the friction with the stopper 203, this cap member 110 can be exchanged with a new cap member 110.

Figure 20:
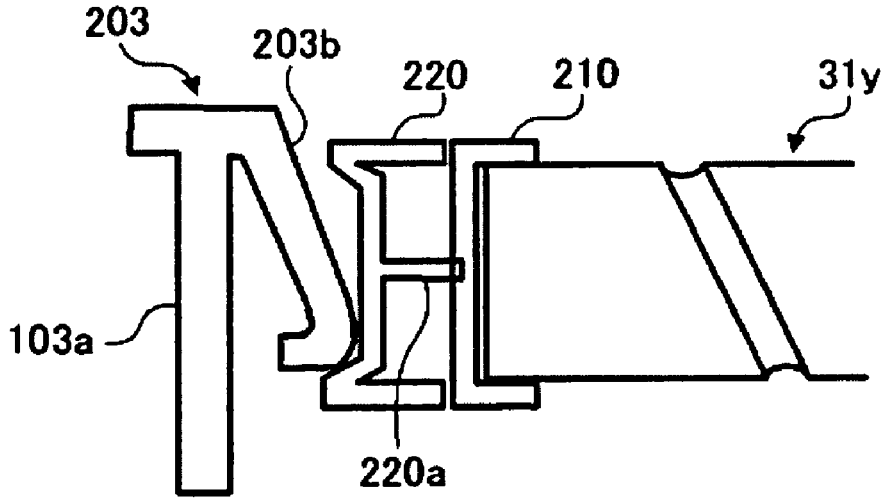
FIG. 20 is a schematic illustration of another exemplary mechanism for protecting the bottom of the toner container.

FIG. 20 illustrates another exemplary structure of increasing a durability of the first longitudinal end 104 of the toner container 31*y*. In this structure of FIG. 20, the toner container 31*y* is provided with a cap member 210 and a ring member 220. The cap member 210 has a U-like shape with a flat top and a dent in the outer surface of the flat top. The ring member 220 has a shape similar to the cap member 110 of FIG. 19, except for a center leg 220*a* which is provided at the center of the ring member 220. To install the ring member 220 to the cap member 210, the center leg 220*a* of the ring member 220 is inserted into the dent formed in the flat top of the cap member 210 so that the ring member 220 is rotatably held by the cap member 210, as illustrated in FIG. 20. Both cap member 210 and ring member 220 are exchangeable. For example, when they are worn out, they can be exchanged with a new one.

This structure achieves reduction of frictional resistance generated between the extensional portion 203*b* and the ring member 220 when the toner container 31*y* having the cap member 210 and the ring member 220 is inserted to its operational position and when the toner container 31*y* is rotated together with the cap member 210, and securing the toner container 31*y* its operational position after the toner container 31*y* is installed to the operational position.

Figure 21:
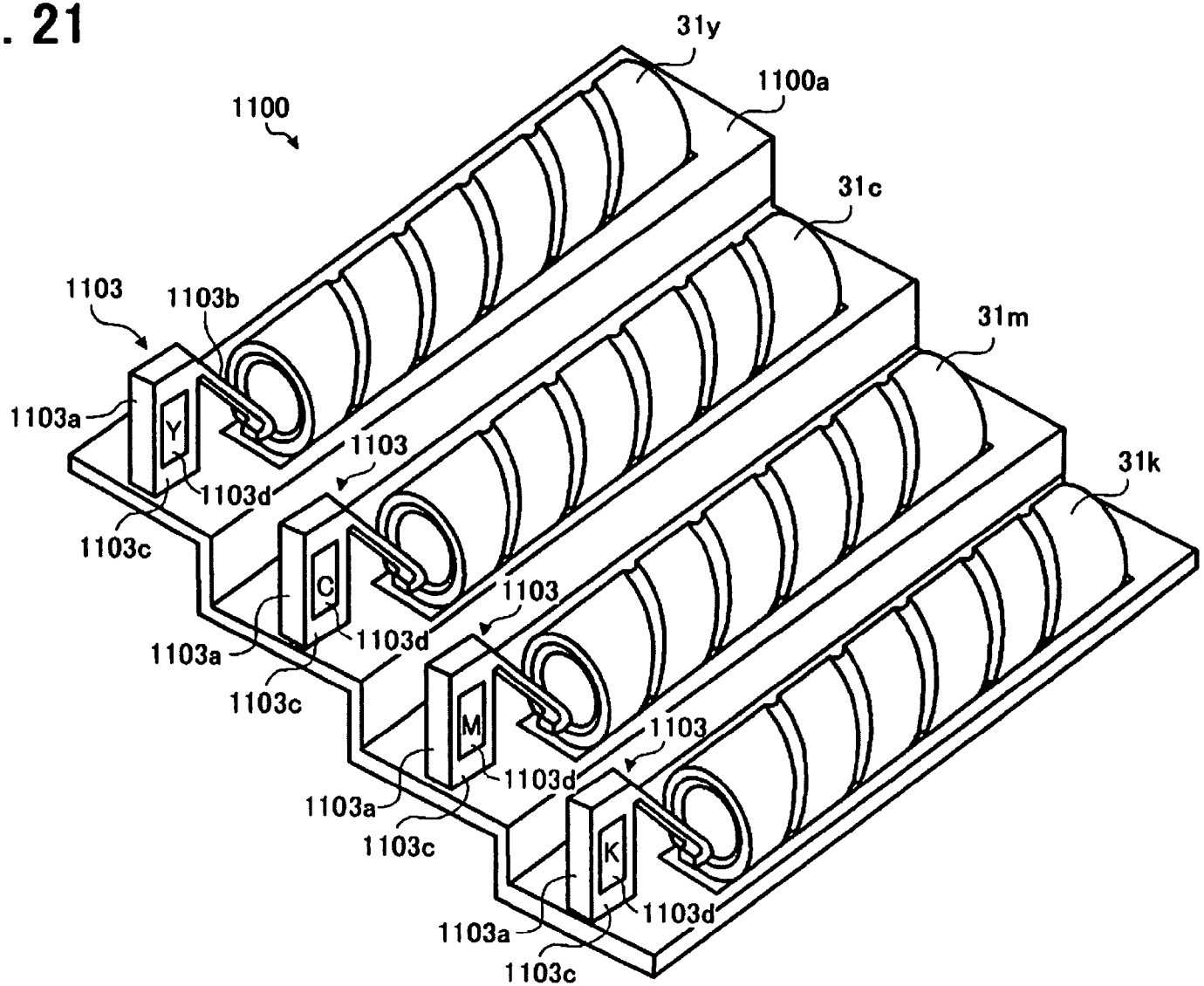
FIG. 21 is a schematic illustration of an exemplary mechanism for securely holding the toner containers and easily identifying colors of the toner containers.

FIG. 21 illustrates an exemplary structure of a toner container supporter 1100 capable of securely holding the toner containers and easily identifying their colors. As illustrated in FIG. 21, the toner container supporter 1100 is similar to the toner container supporter 100 of FIG. 4, except for a base plate 1100*a* and a stopper 1103. Although FIG. 21 does not show, the toner container supporter 1100 includes driving mechanisms similar to those illustrated in FIG. 4 for driving the toner containers 31*y*, 31*c*, 31*m*, and 31*k*.

As illustrated in FIG. 21, the base plate 1100*a* has four stages in a step-like shape at which the toner containers 31*y*, 31*c*, 31*m*, and 31*k* are placed. Each of the four stages of the base plate 1100*a* is provided with the stopper 1103. The stopper 1103 is similar to the stopper 103 of FIG. 4, except for a base pillar 1103*a* which includes a plain surface 1103*c* greater than that of the stopper 103 of FIG. 4. Such a plain surface 1103*c* includes a color identification area 1103*d* which indicates a color of the corresponding toner container by a specific mark printed thereon such as, for example, a letter Y for the yellow toner container 31*y* or using the color itself.

This structure of FIG. 21, particularly, its step-like stages as well as the indication of the stoppers 1103, facilitates visual identification of the toner containers and prevents erroneous insertions of the toner containers to improper stages of the base plate 1100*a*.

The above-described embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of this patent specification may be practiced otherwise than as specifically described herein.

This patent specification is based on Japanese patent application No. JPAP2004-054810 filed on Feb. 27, 2004 in the Japanese Patent Office, the entire contents of which are incorporated by reference herein.

What is claimed is:

1. An image forming apparatus, comprising:

a toner container having a longitudinal length with first and second longitudinal ends, configured to contain toner, to be driven for rotation by a portion close to the second longitudinal end, and to move the toner in a longitudinal direction of the toner container while the toner container is driven for rotation;

an image development mechanism configured to develop an electrostatic latent image into a toner image with the toner contained in the toner container; and a toner container holder configured to hold the toner container, the toner container holder comprising:

a base plate configured to form an upper-open space in which the toner container is inserted in a direction perpendicular to the longitudinal direction of the toner container;

a first supporter including a base pillar having a top portion and a bottom portion, mounted by the bottom portion of the base pillar in a traversal edge side of the base plate, and configured to support the first longitudinal end of the toner container; and a second supporter mounted in an opposite traversal edge side of the base plate and configured to support the second longitudinal end of the toner container.

2. An image forming apparatus of claim 1, wherein the first supporter further includes an arm-like extension member configured to have a free end extended to a place interfering an insertion of the toner container, to be pushed by an insertion of the toner container, and to support the toner container by pushing back with a resilience force of the arm-like extension member.

3. An image forming apparatus of claim 1, wherein the first supporter includes a flexible material.

4. An image forming apparatus of claim 2, wherein the resilience force operates in a direction of supporting the toner container.

5. An image forming apparatus of claim 2, wherein the free end of the arm-like extension member includes a surface which contacts the first longitudinal end of the toner container and which is round-shaped.

6. An image forming apparatus of claim 2, wherein the arm-like extension member of the first supporter is configured to be extended from the top portion downwardly towards the toner container, and the free end of the arm-like extension member includes a supporting surface to contact the first longitudinal end of the toner container.

7. An image forming apparatus of claim 2, wherein the free end of the arm-like extension member which contacts the first longitudinal end of the toner container and which is semisphere-like-shaped.

8. An image forming apparatus of claim 2, wherein the toner container has a protective structure protecting movement of the toner container in a direction opposite from a direction in which the toner container is inserted.

9. An image forming apparatus of claim 8, wherein the first longitudinal end of the toner container has a hollow as the protective structure and the free end of the arm-like extension member pushes a bottom surface of the hollow at a position below a center of the hollow.

10. An image forming apparatus of claim 9, wherein the hollow includes a circumferential edge.

11. An image forming apparatus of claim 8, wherein the first longitudinal end of the toner container has a hollow at a center thereof as the protective structure and the free end of the arm-like extension member has a shape to enter and engage with the hollow.

12. An image forming apparatus of claim 10, wherein the free end of the arm-like extension member has a flat surface to face and contact an inner surface of the circumferential edge of the hollow.

13. An image forming apparatus of claim 8, wherein the first longitudinal end of the toner container has a projection as the protective structure and the free end of the arm-like extension member has a shape to engage with the projection of the first longitudinal end of the toner container.

14. An image forming apparatus of claim 8, wherein the protective structure is provided on a rotation axis of the toner container and allows the toner container to rotate.

15. An image forming apparatus of claim 8, wherein the arm-like extension member pushes the first longitudinal end of the toner container when the toner container is installed and is flexibly deformed during a time the toner container is inserted and removed.

16. An image forming apparatus of claim 2, wherein the base pillar is in parallel to the direction in which the toner container is inserted and includes an engagement portion, and the traversal edge side of the base plate includes a counter engaging portion to which the engagement portion of the base pillar is detachably engaged in the direction in which the toner container is inserted.

17. An image forming apparatus of claim 2, wherein the base pillar is in parallel to the direction in which the toner container is inserted and includes an engagement portion, the traversal edge side of the base plate includes a counter engaging portion to which the engagement portion of the base pillar is detachably engaged in the direction in which the toner container is inserted, and the base pillar is fixed to the traverse edge side of the base plate with a screw.

18. An image forming apparatus of claim 2, wherein the base pillar is in parallel to the direction in which the toner container is inserted and a bottom plate including an engagement portion and to be placed on a surface of the base plate perpendicular to the direction in which the toner container is inserted, the traversal edge side of the base plate includes a counter engaging portion to which the engagement portion of the bottom plate is detachably engaged so that the positioning of the toner container is determined.

19. An image forming apparatus of claim 2, wherein the toner container holder further includes a rotary supporting mechanism for positioning a rotary center of the toner container and allowing a rotation of the toner container.

20. An image forming apparatus of claim 19, wherein the rotary supporting mechanism includes a pair of rollers for contacting a bottom part of a circumferential outer surface of the toner container to rotatably support the toner container from below.

21. An image forming apparatus of claim 19, wherein the rotary supporting mechanism includes a projection provided to the base plate and configured to contact a bottom part of a circumferential outer surface of the toner container to support the toner container from below.

22. An image forming apparatus of claim 19, wherein the rotary supporting mechanism includes a ring-like-shaped projection provided to a circumferential outer surface of the toner container and configured to contact the base plate.

23. An image forming apparatus of claim 1, wherein at least one of the toner container and the first supporter of the toner container holder includes a material of a relatively low friction coefficient.

24. An image forming apparatus of claim 23, wherein the material includes a polyacetal resin.

25. An image forming apparatus of claim 1, wherein the toner container includes a cap member including a relatively low friction coefficient material, detachably mounted to the first longitudinal end, and functioning as a protective member for protecting the first longitudinal end.

26. An image forming apparatus of claim 1, wherein the toner container includes a first cap member integrated with the first longitudinal end and a second cap member including a relatively low friction coefficient material, detachably mounted to the first cap member, and configured to contact a rotary center of the first cap member to allow the first cap member to rotate freely.

27. An image developing apparatus, comprising:

an image development mechanism configured to develop an electrostatic latent image into a toner image with toner contained in a toner container;

a toner container driving mechanism configured to drive the toner container for rotation; and a toner container holder configured to hold the toner container, the toner container holder comprising:

a base plate configured to form an upper-open space in which the toner container is inserted in a direction perpendicular to a longitudinal direction of the toner container;

a first supporter including a base pillar having a top portion and a bottom portion, mounted by the bottom portion of the base pillar in a traversal edge side of the base plate, and configured to support a first longitudinal end of the toner container; and a second supporter mounted in an opposite traversal edge side of the base plate and configured to support a second longitudinal end of the toner container.

28. An image developing apparatus of claim 27, wherein the toner container configured to be exchangeable, to be driven for rotation by a portion close to the second longitudinal end, and to move the toner in a longitudinal direction of the toner container while the toner container is driven for rotation.

29. An image developing apparatus of claim 28, wherein the toner container driving mechanism includes a first gear and the toner container includes a second gear which engages with the first gear of the toner container driving mechanism and is driven by the first gear for rotation, wherein moving directions of the first and second gears at a point of engagement is in agreement with a direction in which the toner container is inserted.

30. An image developing apparatus of claim 29, wherein the base plate has four stages in a step shape and one set of the first and second supporters is provided to each one of the four stages.

31. An image developing apparatus of claim 30, wherein each of the first supporters provided to the four stages includes a toner type identifier.

32. An image developing apparatus of claim 31, wherein the toner type identifier includes a printed alphanumeric mark.

33. An image developing apparatus of claim 31, wherein the toner type identifier includes a geometric indication.

34. A powder container holding apparatus, comprising:

a base plate configured to form an upper-open space in which a powder container is inserted in a direction perpendicular to a longitudinal direction of the powder container, the powder container being configured to be rotated to move powder contained therein along the longitudinal direction of the powder container;

a first supporter including a top portion and a bottom portion, mounted by the bottom portion in a traversal edge side of the base plate, and configured to support a first longitudinal end of the powder container; and a second supporter mounted in an opposite traversal edge side of the base plate and configured to support a second longitudinal end of the powder container.

35. A powder container holding apparatus of claim 34, wherein the first supporter includes an arm-like extension member configured to have a free end extended to a place interfering an insertion of the powder container, to be pushed by an insertion of the powder container, and to support the powder container by pushing back with a resilience force of the arm-like extension member.

* * * * *